US008648721B2

(12) United States Patent
Copeland et al.

(10) Patent No.: US 8,648,721 B2
(45) Date of Patent: Feb. 11, 2014

(54) SECURITY TAG WITH INTEGRATED EAS AND ENERGY HARVESTING MAGNETIC ELEMENT

(75) Inventors: Richard L. Copeland, Lake Worth, FL (US); Edward Day, Pembroke Pines, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 856 days.

(21) Appl. No.: 12/852,918

(22) Filed: Aug. 9, 2010

(65) Prior Publication Data

US 2012/0032803 A1 Feb. 9, 2012

(51) Int. Cl.
*G08B 13/14* (2006.01)

(52) U.S. Cl.
USPC ..... 340/571; 340/572.1; 340/572.4; 340/572.5; 340/572.6

(58) Field of Classification Search
USPC ..... 340/571–572.6
See application file for complete search history.

(56) References Cited

U.S. PATENT DOCUMENTS

| | | | | |
|---|---|---|---|---|
| 5,491,468 | A * | 2/1996 | Everett et al. | 340/10.34 |
| 5,838,074 | A * | 11/1998 | Loeffler et al. | 340/5.61 |
| 6,195,009 | B1 * | 2/2001 | Irizarry et al. | 340/573.4 |
| 6,856,291 | B2 * | 2/2005 | Mickle et al. | 343/701 |
| 6,879,809 | B1 | 4/2005 | Vega et al. | |
| 7,106,200 | B2 * | 9/2006 | Hall et al. | 340/572.3 |
| 7,132,946 | B2 * | 11/2006 | Waldner et al. | 340/572.1 |
| 7,373,133 | B2 * | 5/2008 | Mickle et al. | 455/343.1 |
| 7,463,155 | B2 * | 12/2008 | Narlow et al. | 340/572.7 |
| 7,532,120 | B2 * | 5/2009 | Estevez et al. | 340/572.1 |
| 7,564,360 | B2 * | 7/2009 | Cote et al. | 340/572.9 |
| 7,786,868 | B2 * | 8/2010 | Forster | 340/572.1 |
| 7,817,044 | B2 * | 10/2010 | Posamentier | 340/572.7 |
| 2002/0021218 | A1 | 2/2002 | Qiu et al. | |
| 2006/0049947 | A1 | 3/2006 | Forster | |

(Continued)

FOREIGN PATENT DOCUMENTS

EP 0768629 A1 4/1997

OTHER PUBLICATIONS

AIM., "Electronic Article Surveillance: EAS Overview of the Major Technologies." Association for Automation, Identification and Mobility. [Online ] http://www.aimglobal.org/technologies/EAS/easoverview.asp (last visited Aug. 12, 2010 10:40:36 AM), (pp. 1-4).

(Continued)

*Primary Examiner* — Daniel Wu
*Assistant Examiner* — Son M Tang
(74) *Attorney, Agent, or Firm* — Alan M. Weisberg; Christopher & Weisberg, P.A.

(57) ABSTRACT

An EAS security tag for providing both EAS and battery recharging features within one tag. The tag includes a rechargeable battery and an antenna having a magnetic core and at least one coil winding disposed around at least a portion of the core. The antenna supplies a voltage corresponding to a first frequency or a second frequency when placed within a magnetic field. The tag also includes an EAS circuit having a resonant frequency corresponding to the first frequency, and an energy harvesting circuit having a resonant frequency corresponding to the second frequency, where the battery recharging circuit recharges the rechargeable battery. Depending upon the magnetic field that the tag is exposed to, either the EAS circuit is enabled thus allowing for EAS detection or the energy harvesting circuit is enabled allowing for the battery to be recharged.

20 Claims, 4 Drawing Sheets

(56) References Cited

U.S. PATENT DOCUMENTS

| | | | | |
|---|---|---|---|---|
| 2006/0176229 | A1 | 8/2006 | Copeland et al. | |
| 2006/0273901 | A1 | 12/2006 | Hall et al. | |
| 2006/0273902 | A1 | 12/2006 | Shafer et al. | |
| 2007/0205902 | A1 | 9/2007 | Cote et al. | |
| 2008/0204247 | A1* | 8/2008 | Lian et al. | 340/572.3 |
| 2009/0140860 | A1* | 6/2009 | Forster | 340/572.1 |
| 2010/0097280 | A1 | 4/2010 | Zirbes et al. | |
| 2010/0148965 | A1* | 6/2010 | Alexis et al. | 340/572.1 |
| 2011/0163857 | A1* | 7/2011 | August et al. | 340/10.42 |

OTHER PUBLICATIONS

Mickle et al., "Intellectual Property and Ubiquitous RFID", Recent Patents on Electrical Engineering (2008), vol. 1,, (pp. 59-67).

Daniel W. Harrist, Thesis: "Wireless Battery Charging System Using Radio Frequency Energy Harvesting", Submitted to the Graduate Faculty of The School of Engineering in partial fulfillment of the requirements for the degree of Master of Science, University of Pittsburgh (2004) (pp. 1-69).

Ibrahim Braimah, Published Dissertation "Feasibility Study of Radio-Frequency (Rf) Inductor Energy Harvesting", Submitted to the Department of Industrial Engineering in partial fulfillment of the requirements for the degree of Doctor of Philosophy, Degree Awarded: Summer Semester, 2007 Copyright © 2007 All Rights Reserved, (pp. 1-102).

EPO International Search Report dated Nov. 11, 2011 for corresponding appln PCT/US11/01397.

* cited by examiner

SECURITY TAG WITH INTEGRATED EAS AND ENERGY HARVESTING MAGNETIC ELEMENT

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates generally electronic article surveillance security systems and in particular to a security system tag and method having an integrated energy harvesting circuit.

BACKGROUND OF THE INVENTION

Electronic article surveillance ("EAS") systems are commonly used in retail stores and other settings to prevent the unauthorized removal of goods from a protected area. Typically, a detection system is configured at an exit from the protected area, which comprises one or more transmitters and antennas ("pedestals") capable of generating an electromagnetic field across the exit, known as the "interrogation zone." Articles to be protected are tagged with an EAS marker that, when active, generates a response signal when passed through this interrogation zone. An antenna and receiver in the same or another "pedestal" detects this response signal and generates an alarm. Certain EAS tags, commonly known as "alarming" tags, include a processor and audible alarm transducer within the actual tag device. Thus, the actual tag "knows" when it has been interrogated by an EAS portal and emits an audible alert when triggered.

Irrespective of the specific type of EAS tag in use, EAS tags often include a power supply, such as a battery, that powers the internal components of the tag for use. Indeed, tags often include a battery or similar power supply that is permanently fixed within the tag itself to prevent shoplifters or other persons from removing or tampering with it. The tags are typically designed and manufactured such that access to the power supply is unavailable. Such removal or tampering would render the tag inoperable, thus defeating it as a security measure. Although in practice EAS tags are typically removed from an article upon purchase and subsequently stored for reuse on subsequent goods, a tag's ability to be reused may be undesirably limited by the life of the permanently affixed power supply. This limiting characteristic may thus result in the inability to effectively use a tag for a lengthy period of time, instead resulting in discarded tags replaced by tag with a fresh power supply, thereby increasing the overall cost of securing one's goods.

Some tag solutions include incorporating energy management hardware such as a wake-up switch in order to manage and limit the energy consumption. Typically, energy management hardware operates to limit tag power, performance and functionality in order to achieve long battery life. Such a result is undesirable.

Further, although one solution might be to include a very large power supply in the tag, such a solution is undesirable for a number of reasons. First, larger power supplies, e.g., batteries, add cost and weight to the tag as compared with smaller batteries. Second, a larger battery means a physically larger tag housing. Because the tags should be as unobtrusive as possible, affixing a physically large tag to an item can adversely impact the attractiveness of the protected item to the potential item purchaser. Also, as tag functionality increases, e.g., tags providing both EAS and radio frequency identification ("RFID") functionality, the need to include additional components and circuitry inside the tag house also increases. As such, tag housing space resources are better used to provide the additional functionality as opposed to merely using the space for a large power supply.

It is therefore desirable to have a tag that can be repeatedly reused, despite the permanently affixed power supply, in a manner that does not necessitate a significant increase in tag size as compared with known tags.

SUMMARY OF THE INVENTION

The present invention advantageously provides a method and system for providing EAS and RFID along with battery recharging features within a single security tag. The EAS security tag includes a rechargeable battery and an antenna having a magnetic core and at least one coil winding disposed around at least a portion of the core. The antenna supplies a voltage corresponding to a first frequency or a second frequency depending on the frequency corresponding to the magnetic field the tag is placed within. The tag includes an EAS circuit having a resonant frequency corresponding to the first frequency, and an energy harvesting circuit having a resonant frequency corresponding to the second frequency, where the energy harvesting circuit recharges the rechargeable battery. Depending upon the magnetic field that the tag is exposed to, either the EAS circuit is enabled thus allowing for EAS detection or the energy harvesting circuit is enabled allowing for the battery to be recharged.

In addition, a battery assisted or active RFID element connected to an RFID tag antenna allows for sensor inputs through the I/O pins to generate an alarm message, such as when the security tag has entered into an EAS system. This message is broadcast to an RFID reader which can alert store personnel what items have left the store in an unauthorized manner. The RFID element can also generate an alarm or alert message when the battery charge is low, alerting store personnel that the tag needs to be re-charged In one aspect of the invention, a security tag is provided. The tag includes a rechargeable battery, a magnetic element comprising a magnetic core and at least one coil winding disposed around at least a portion of the core, where the magnetic element supplies a voltage corresponding to applied magnetic fields of a first frequency and a second frequency, an EAS circuit having a resonant frequency corresponding to the first frequency, and an energy harvesting circuit having a resonant frequency corresponding to the second frequency, the energy harvesting circuit converting the second frequency voltage to a battery voltage signal for the rechargeable battery.

In yet another aspect of the invention, a security tag is provided. The security tag includes a rechargeable battery, and a magnetic element configured to supply a voltage corresponding to applied magnetic fields of a first frequency and a second frequency. The magnetic element includes a magnetic core, a first coil winding disposed around at least a portion of the magnetic core, the first winding corresponding to the first frequency, and a second coil winding disposed around at least a portion of the magnetic core, the second winding corresponding to the second frequency. The tag also includes an EAS circuit having a resonant frequency corresponding to the first frequency, and an energy harvesting circuit having a resonant frequency corresponding to the second frequency, the energy harvesting circuit converting the second frequency voltage to a battery recharging signal for the rechargeable battery.

In another aspect of the invention, a method for integrating EAS and battery recharging capabilities within a security tag is provided. The security tag includes a magnetic element having a magnetic core and at least one coil winding disposed around at least a portion of the core, the magnetic element supplying a voltage corresponding to applied magnetic fields of a first frequency and a second frequency. The method includes enabling the EAS mode when the magnetic element is placed within a magnetic field corresponding to a first frequency, and enabling the energy harvesting mode when the magnetic element is placed within a magnetic field corresponding to a second frequency.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
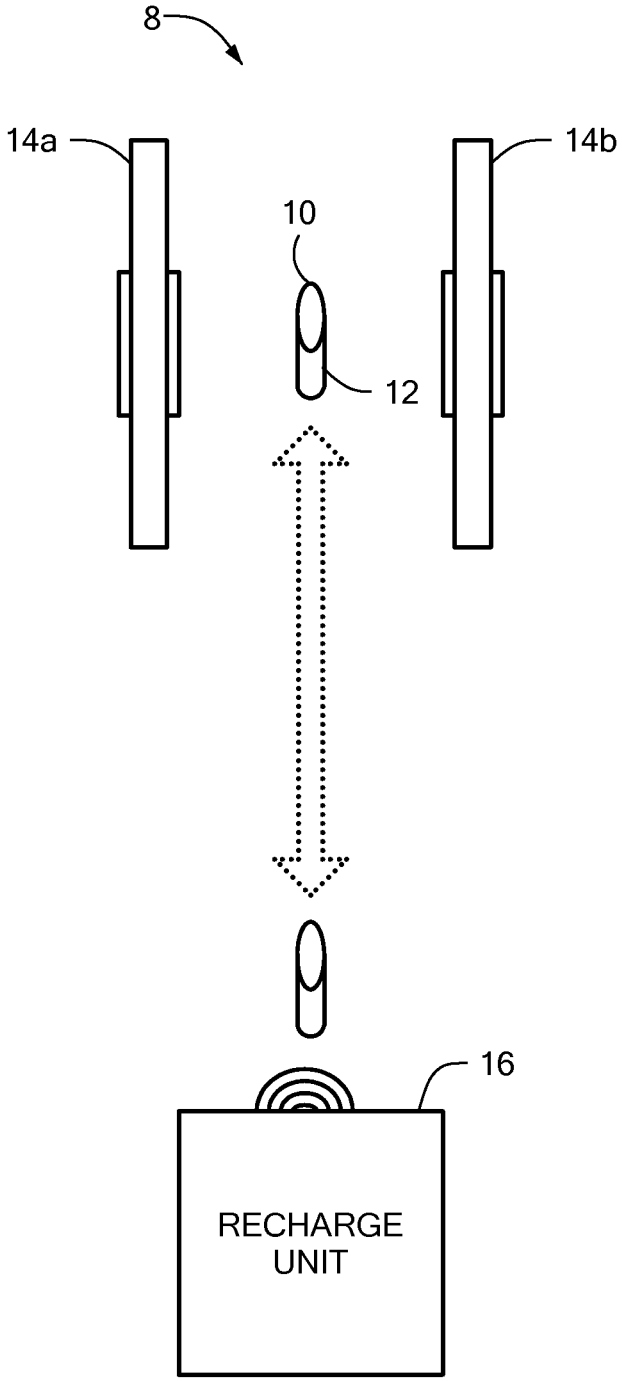
FIG. 1 is a top view of an exemplary EAS system including an EAS tag and an EAS recharging station constructed in accordance with the principles of the present invention.

Before describing in detail exemplary embodiments that are in accordance with the present invention, it is noted that the embodiments reside primarily in combinations of apparatus components and processing steps related to implementing a system and method for integrating the function of an EAS detection signal, an EAS internal alarm signal, and an energy harvesting function into one element within an EAS tag.

Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

One embodiment of the present invention advantageously provides a security tag that includes a magnetic element having different modes, an EAS mode, an energy harvesting mode and an RFID mode. When in the EAS mode, a circuit in the EAS tag that has a resonant frequency corresponding to an EAS frequency allows the tag to be interrogated by an EAS pedestal in the interrogation zone and to generate a system alarm and a tag alarm. The tag alarm can include a sound device like a piezo speaker and a wireless alarm from the RFID element broadcasting to a RFID reader When in the energy harvesting mode, the tag can be recharged when placed in proximity to a battery recharging station.

Referring now to the drawing figures in which like reference designators refer to like elements, there is shown in FIG. 1 an exemplary configuration of an EAS system 8 that includes an EAS security tag 10 according to an embodiment of the present invention. In FIG. 1, security tag 10 is affixed to an item 12 and is positioned proximate two electronic detection units such as pedestals 14*a* and 14*b* (collectively referred to as "pedestals 14") that form an EAS tag interrogation zone. The electronic detection units need not be in the form of standing pedestals 14 but can also be buried under floors, mounted on walls, or hung from ceilings. In addition to tag 10 and pedestals 14, EAS system 8 also includes a tag detacher or tag deactivator (not shown). Pedestals 14 are usually placed in high traffic areas, such as entrances and exits of stores or office buildings. Tag 10 is specifically designed to be affixed to or embedded in merchandise or other items 12 sought to be protected. When an active tag 10 passes through a tag detection zone without being deactivated, such as during a shoplifting scenario, EAS system 8 sounds an alarm, a light is activated and/or some other suitable alert devices are activated to indicate the removal of tag 10 from the prescribed area.

Figure 2:
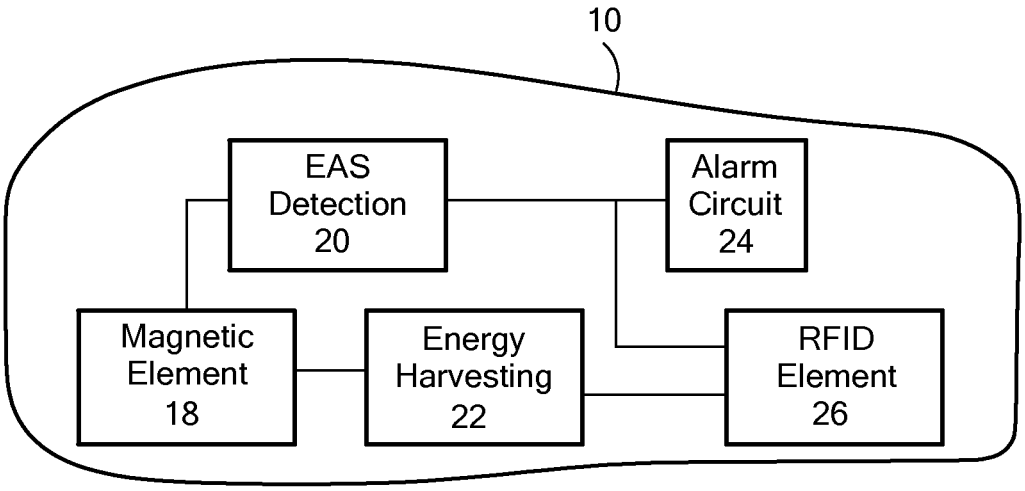
FIG. 2 is a block diagram showing the components of an EAS tag incorporating the features of the present invention.

EAS system 8 also includes a tag battery recharge unit 16. Tag 10 contains a rechargeable battery that when placed in proximity of battery recharge unit 16, recharges the battery to allow tag 10 to operate for a given period of time such as, for example, for several months. As described below, tag 10 advantageously contains a magnetic element that can operate in different modes. The first mode is an EAS mode that allows tag 10 to be detected by the electronic detection units of the EAS system and also broadcasting an EAS alarm message to an RFID reader. The second mode is an energy harvesting mode that allows the battery of tag 10 to be recharged when brought in proximity to battery recharge unit 16. The third mode is an RFID mode where the tagged item RFID element can be read or written to, by using an RFID reader FIG. 2 is a block diagram of an exemplary security tag 10 and the electrical components contained therein. In one embodiment, tag 10 includes a magnetic element 18 which can perform an EAS function, an energy harvesting function using a common core element, and an RFID function. This arrangement is described in greater detail below. Magnetic element 18 is not limited to a particular arrangement and can, for example, have a ferrite or laminated magnetic material core around which is a single winding. Magnetic element 18 operates in two different modes, each corresponding to a different frequency. One frequency corresponds to the EAS function, represented by EAS detection module 20, and the other frequency corresponds to the energy harvesting feature, represented by the energy harvesting module 22. Certain tags 10 also include an alarm circuit 24 that include a processor and audible alarm transducer such that when tag 10 is interrogated by an EAS detection unit 14, the tag 10 emits an audible, visual or tactile alert. In one embodiment, tag 10 includes an RFID element 26, which provides a signal to an RFID reader informing the RFID reader of the occurrence of an alarm event generated by tag 10. RFID element 26 can also inform the RFID reader of the tag's battery charge status in order to determine if and when tag 10 needs recharging.

Figure 3:
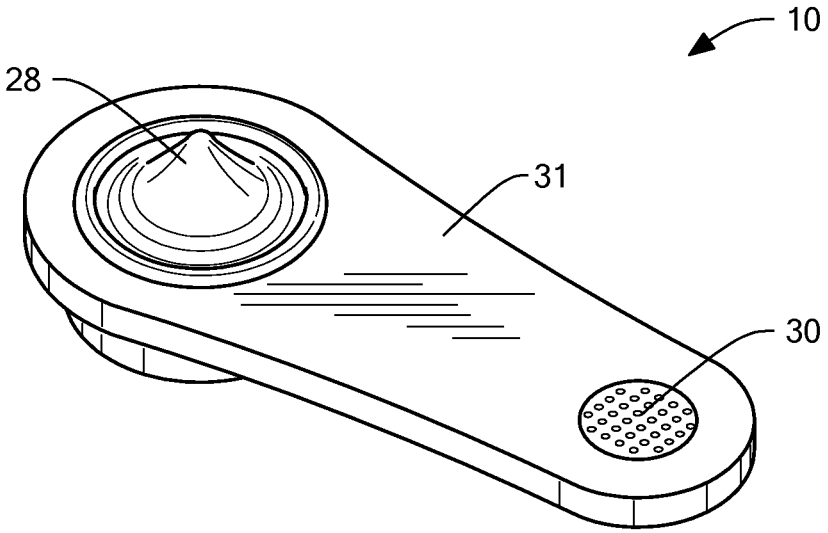
FIG. 3 is a perspective view of an exemplary EAS tag constructed in accordance with the principles of the present invention.
Figure 4:
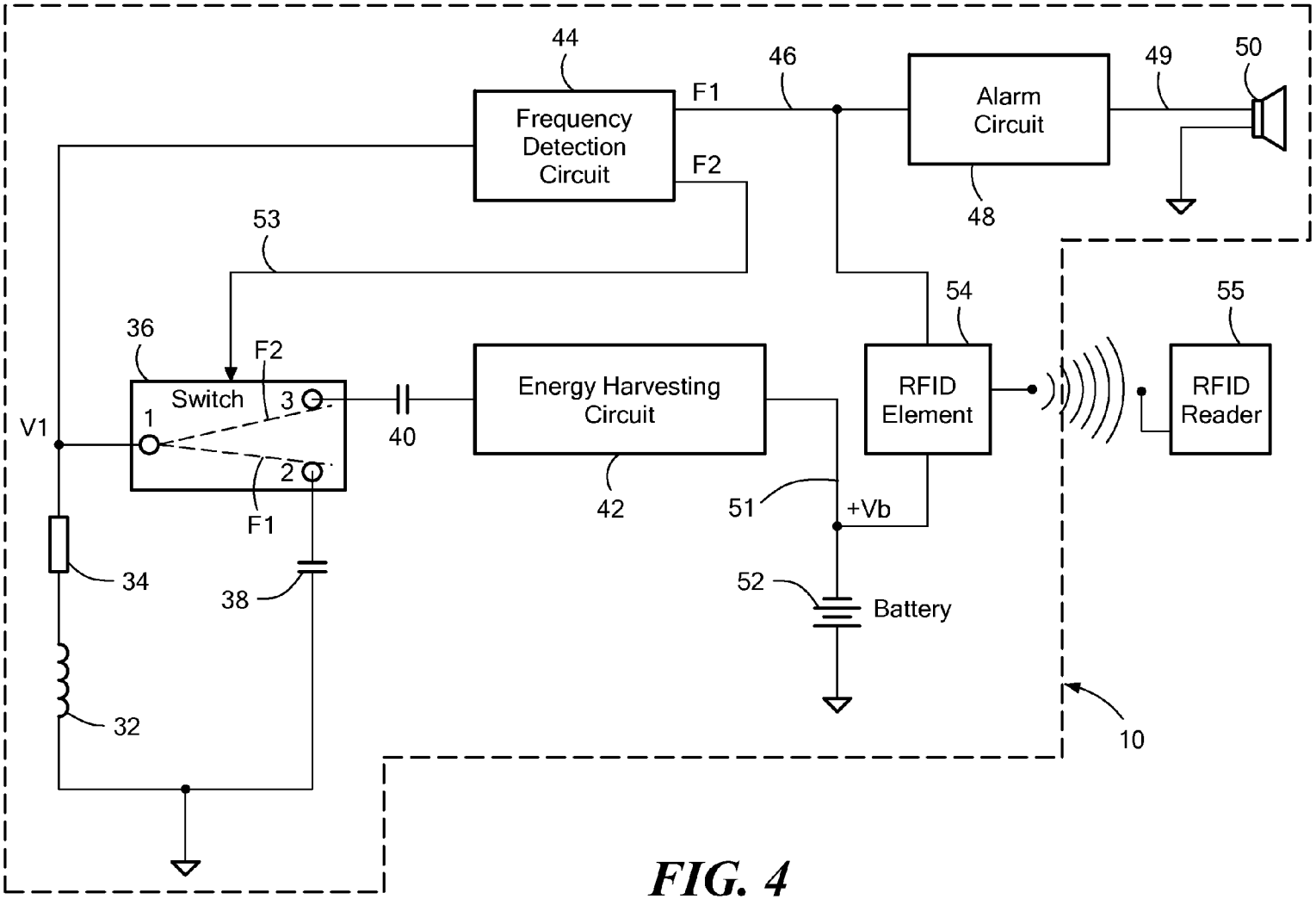
FIG. 4 is a schematic diagram of an EAS tag constructed in accordance with the present invention incorporating an EAS alarm circuit and an energy harvesting circuit.

FIG. 3 is a perspective view of an exemplary security tag 10 utilizing the present invention. Tag 10 includes an attachment mechanism 28 and a plurality of openings 30. Attachment mechanism 28 can be in the form of a clamp having a pin, which allows tag 10 to be attached to an object, such as a garment. The pin is inserted through the object and is locked to the body 31 of the tag. When tag 10 arrives at the point of service ("POS"), tag 10 is removed from the object to which it is attached and/or is deactivated. Should an object be taken beyond the POS without its tag 10 being deactivated or removed, an alarm will sound via an internal speaker mounted just below the openings 30 in tag 10. The alarm will be activated and the sound will permeate through openings 30 in tag 10. The invention is not limited to an audible alarm, i.e., a visual alarm, such as a strobe light emanating from tag 10 may also be used. In addition, an EAS alarm message may be broadcast from the RFID element to an RFID reader. FIG. 4 is a schematic drawing of one exemplary embodiment of the present invention. The schematic of FIG. 4 depicts the various electrical components within tag 10 that allow tag 10 to be interrogated in an EAS system environment as well as allowing a rechargeable battery within tag 10 to be recharged when brought in proximity to battery recharge unit 16. Tag 10 has a magnetic element acting as a low frequency antenna, which includes a single winding over a magnetic core material. In FIG. 4, the winding and magnetic core are represented by inductor 32 and resistor 34. Voltage V1 appears across the magnetic core winding. The signal received by the antenna drives two circuits, an EAS circuit and an energy harvesting circuit. Each circuit resonates at a particular frequency. For example, the EAS circuit may resonate at a first frequency (F1) of 58 kHz and the energy harvesting circuit may resonate at a second frequency (F2) of 125 kHz. These numbers are exemplary only and the invention is not limited to a specific resonating frequency for either the EAS circuit or the energy harvesting circuit.

In one embodiment, a switch 36 connects the core output voltage V1 to either capacitor 38 or capacitor 40. In the normally closed position, switch 36 connects pins 1 and 2 so that the EAS series circuit is closed, including inductor 32, resistor 34 and capacitor 38. When tag 10 is brought within a magnetic field, a voltage is induced across the antenna 34. This magnetic field can induce a voltage V1 having a particular frequency depending upon the magnetic field, i.e., a magnetic field produced by an EAS system or a battery recharging station. When tag 10 is brought in proximity to a magnetic field having a frequency F2 corresponding to battery recharge unit 16, contacts 1 and 3 of switch 36 are shorted together and a different circuit that includes capacitor 40 enables an energy harvesting circuit 42. Energy harvesting circuit 42 is referred to interchangeably throughout this specification with the term "battery recharging circuit." Note that in one embodiment, the EAS circuit is enabled unless the tag is in the presence of the energy harvesting field.

In one embodiment, as described above, the contacts 1 and 2 of switch 36 are shorted together by default, enabling the EAS circuit and placing tag 10 in an EAS mode. When in EAS mode, tag 10 can generate a response or an alarm signal when it passes through an EAS interrogation zone. When tag 10 is present within the magnetic field corresponding to an EAS system, voltage V1 is generated and applied to a frequency detection circuit 44. Frequency detection circuit 44 determines the frequency associated with the voltage V1 signal and may use bandpass filters and comparators, for example. If frequency detection circuit 44 determines that the frequency corresponds to the EAS mode, i.e., frequency F1, frequency detection circuit 44 can produce an EAS alarm enable signal 46. Thus, for example, when tag 10 is brought to a location near pedestals 14 of an EAS system, the magnetic element of tag 10 generates a voltage at a frequency which frequency detection circuit 44 recognizes as a frequency related to an EAS interrogation signal (F1). This frequency corresponds to the resonating frequency of the EAS circuit. The contacts 1 and 2 of switch 36 remain shorted together, and when voltage V1 reaches a predetermined level, frequency detection circuit 44 produces an EAS alarm enable signal 46. Certain security tags 10, commonly known as "alarming" tags, include a processor and audible alarm transducer within the actual tag device.

Thus, security tag 10 "knows" when it has been interrogated by an EAS portal and emits an audible alert when triggered. In these "alarming" tags, EAS alarm enable signal 46 triggers an EAS alarm circuit 48, which is connected to an alarm device 50, such as a piezoelectric speaker. Alarm circuit 48 produces an EAS alarm activation signal 49, which drives alarm device 50 to emit an alarm signal. As mentioned above, alarm device 50 need not be audible, but can be a visual alarm device, such as a strobe light, or any other type of alarm capable of alerting a third party that an EAS alarm event has occurred. Also, although not shown in FIG. 4 for the sake of simplicity, voltage Vb is provided to alarm circuit 48 to drive alarm device 50.

Tag 10 includes a rechargeable battery 52 having a voltage Vb, which when brought into proximity to battery recharge unit 16, can be recharged in order to allow tag 10 to be reused. When the magnetic core of tag 10 is placed within a magnetic field source corresponding to a frequency (F2) that corresponds to the resonating frequency of energy harvesting circuit 42, i.e., placed near battery recharge unit 16, frequency detection circuit 44 detects a frequency F2 and sends a switch enable signal 53 to switch 36. Upon receipt of switch enable signal 53, switch 36 disconnects contacts 1 and 2 and connects contacts 1 and 3, thus connecting the magnetic core to capacitor 40 and energy harvesting circuit 42. This results in the transmission of a battery recharging signal 51 to battery 52, which charges battery 52. Advantageously, one embodiment of the present invention provides two circuits, an EAS circuit resonating at one frequency and battery recharging circuit 42 resonating at a second frequency, both provided within one EAS tag 10.

In one embodiment, EAS alarm enable signal 46 is transmitted to one of the I/O ports of an RFID element 54, within EAS tag 10. RFID element 54 can be either a battery assisted or active chip or device. RFID element 54 can transmit a wireless signal or message to an RFID reader 55. The signal from RFID element 54 to RFID reader 55 informs RFID reader 55 that an EAS alarming condition has occurred in tag 10. The signal can include tag identification information about tag 10, thus informing RFID reader 55 not only that an EAS alarm event has occurred but also to which tag 10 the alarm event relates. This is especially useful for store management so they instantly know what items are setting off the EAS system.

In another embodiment, RFID element 54 also receives a signal indicating the charge status of battery 52. Based on this signal, RFID element 54 transmits a low battery signal to RFID reader 55 when a voltage of rechargeable battery 52 voltage falls below a predetermined threshold. At the POS, when the tag 10 is removed from its item, an RFID reader 55 can detect the battery charge status from RFID element 54 and transmit an alert that a particular tag needs to be recharged. When a tag 10 having a low battery charge is placed in proximity of battery recharge unit 16 (FIG. 1), RFID element 54 can continue to report on the status of the battery charge for its tag by utilizing the ID code of the tag 10.

Figure 5:
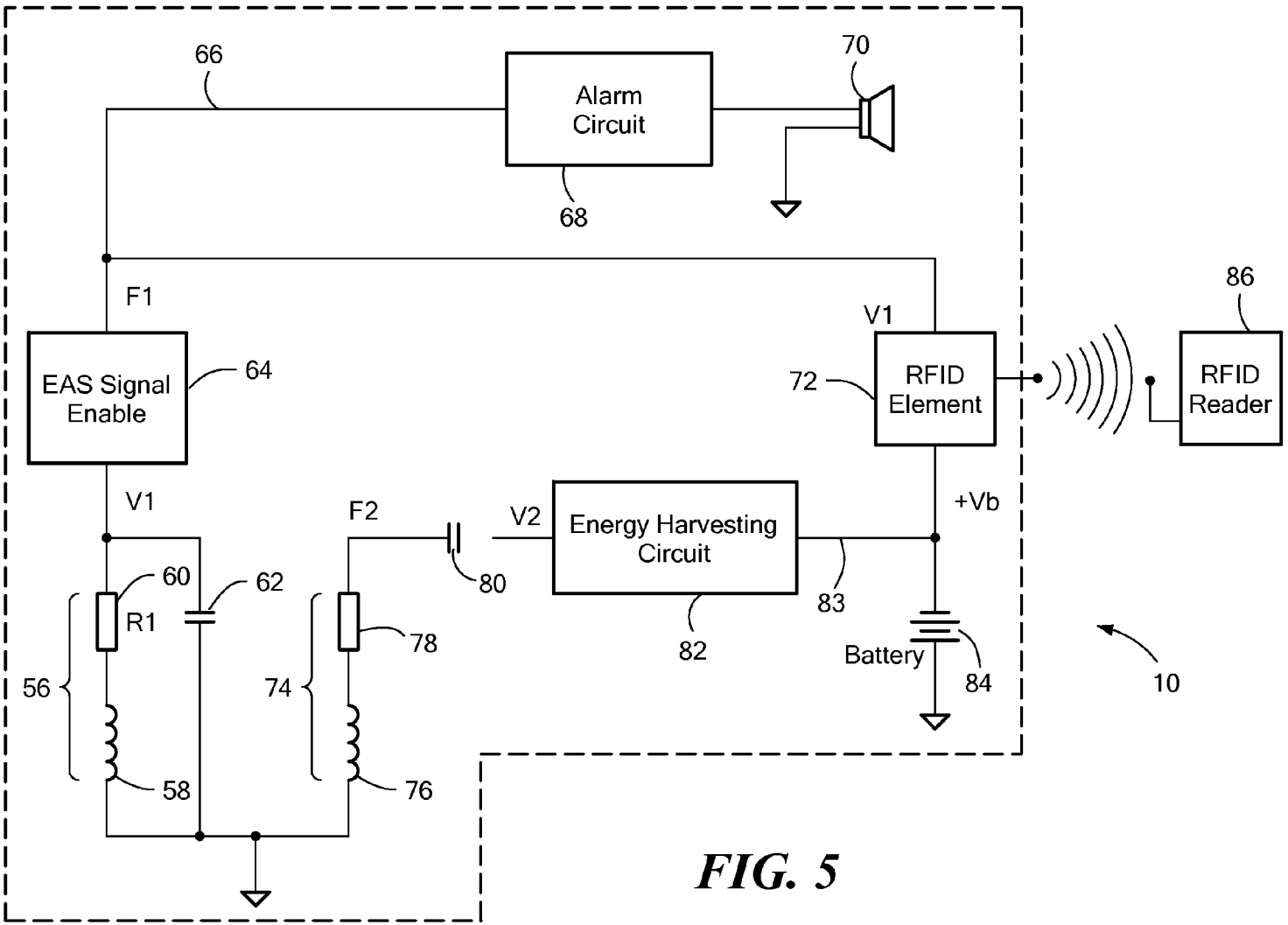
FIG. 5 is a schematic diagram of an alternate embodiment of the present invention.

FIG. 5 depicts an alternate exemplary embodiment of the invention. In the embodiment of FIG. 5, a dual winding is used over a single magnetic core. A first EAS winding 56 is represented in FIG. 5 by inductor 58 and resistor 60. The first EAS winding 56 is placed in an electrically parallel relationship with capacitor 62, thereby being tuned to an associated frequency F1. Voltage V1 appears across the magnetic core when placed in a magnetic field having a frequency F1. When the level of voltage V1 at frequency F1 reaches a predetermined level, an EAS signal enable circuit 64 creates an enable signal 66 that triggers an alarm circuit 68 driving an alarm device 70, such as a piezoelectric speaker, a strobe light or the like. In one embodiment, enable signal 66 may also be applied to RFID chip 72 through one of the I/O ports allowing an EAS alarm signal to be sent to a remote RFID reader 86.

A second winding 74 is represented by inductor 76 and resistor 78, in series with capacitor 80 and is tuned to frequency F2. When the magnetic core is placed by battery recharge unit 16 transmitting a signal at frequency F2, and voltage V2 reaches a predetermined level, energy harvesting circuit 82 provides a battery recharge signal 83 at voltage Vb to battery 84, recharging battery 84. This embodiment is similar to the earlier-described embodiment except that it uses an additional winding layer and does not use a switch or a frequency detection circuit.

Thus, the present invention advantageously provides a security tag 10 that uses a single magnetic core to provide an EAS detection signal, an EAS internal alarm signal that can also be sent wirelessly using the RFID element to a RFID reader, and an energy harvesting signal for charging an internal rechargeable battery. A battery assisted or active RFID element may be used in security tag 10 to create an EAS alarm mode signal and to monitor the battery charge state. A single printed circuit board may be used in tag 10 to support all of the components that are used for EAS and RFID functions.

The present invention can be realized in hardware, software, or a combination of hardware and software. Any kind of computing system, e.g., digital signal processor, gate array, microcontroller, etc., or other apparatus adapted for carrying out the methods described herein, is suited to perform the functions described herein.

Software in the present context means any expression, in any language, code or notation, of a set of instructions intended to cause a system having an information processing capability to perform a particular function either directly or after either or both of the following a) conversion to another language, code or notation; b) reproduction in a different material form.

In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. A security tag comprising:

a rechargeable battery;

a magnetic element comprising a magnetic core and at least one coil winding disposed around at least a portion of the core, the magnetic element supplying a voltage corresponding to applied magnetic fields of a first frequency and a second frequency;

an EAS circuit having a resonant frequency corresponding to the first frequency; and an energy harvesting circuit having a resonant frequency corresponding to the second frequency, the energy harvesting circuit converting the second frequency voltage to a battery voltage signal for the rechargeable battery.

2. The security tag of claim 1, further comprising a frequency detection circuit in communication with the magnetic element, the frequency detection circuit determining whether the voltage produced by the magnetic element when within the magnetic field corresponds to the first frequency or the second frequency, the frequency detection circuit providing an EAS alarm enable signal if the magnetic field corresponds to the first frequency and a switch enable signal if the magnetic field corresponds to the second frequency.

3. The security tag of claim 2, wherein if the voltage produced by the magnetic element corresponds to the second frequency, the energy harvesting circuit is enabled, and produces the battery voltage signal.

4. The security tag of claim 3, further comprising an RFID element, the RFID element receiving at least one of the EAS alarm enable signal and the battery voltage signal.

5. The security tag of claim 4, wherein the RFID element is operable to determine a battery charge status from the battery voltage signal.

6. The security tag of claim 4, wherein the RFID element is in electrical communication with an RFID reader, the RFID element transmitting a low battery signal to the RFID reader when a voltage of the rechargeable battery falls below a predetermined threshold.

7. The security tag of claim 2, further comprising a switch, the switch receiving the switch enable signal from the frequency detection circuit, wherein the switch enables the energy harvesting circuit if the switch receives the switch enable signal.

8. The security tag of claim 2, further comprising an EAS alarm circuit in communication with the frequency detection circuit, the EAS alarm circuit receiving the EAS alarm enable signal from the frequency detection circuit.

9. The security tag of claim 8, further comprising an alarm device, the alarm device receiving an EAS alarm activation signal from the EAS alarm circuit and producing an alarm in response thereto.

10. A security tag comprising:

a rechargeable battery;

a magnetic element configured to supply a voltage corresponding to applied magnetic fields of a first frequency and a second frequency, the magnetic element comprising:

a magnetic core;

a first coil winding disposed around at least a portion of the magnetic core, the first winding corresponding to the first frequency; and a second coil winding disposed around at least a portion of the magnetic core, the second winding corresponding to the second frequency;

an EAS circuit having a resonant frequency corresponding to the first frequency; and an energy harvesting circuit having a resonant frequency corresponding to the second frequency, the energy harvesting circuit converting the second frequency voltage to a battery voltage signal for the rechargeable battery.

11. The security tag of claim 10, wherein the EAS circuit is enabled if the magnetic element supplies a voltage corresponding to the first frequency and the energy harvesting circuit is enabled if the magnetic element supplies a voltage corresponding to the second frequency.

12. The security tag of claim 10, wherein if the voltage supplied by the magnetic element corresponds to the first frequency, an EAS alarm enable signal is enabled and if the voltage supplied by the magnetic element corresponds to the second frequency, the energy harvesting circuit is enabled, and produces the battery voltage signal.

13. The security tag of claim 12, further comprising an RFID element, the RFID element receiving at least one of the EAS alarm enable signal and the battery voltage signal.

14. The security tag of claim 12, wherein the RFID element is operable to determine a battery charge status from the battery voltage signal.

15. The security tag of claim 12, wherein the RFID element is in electrical communication with an RFID reader, the RFID element transmitting a low battery signal to the RFID reader when a voltage of the rechargeable battery falls below a predetermined threshold.

16. The security tag of claim 10, further comprising an EAS alarm circuit for providing an EAS alarm signal.

17. A method for integrating EAS and battery recharging capabilities within a security tag, the security tag including a magnetic element having a magnetic core and at least one coil winding disposed around at least a portion of the core, the magnetic element supplying a voltage corresponding to applied magnetic fields of a first frequency and a second frequency, the method comprising:

enabling the EAS mode when the magnetic element is placed within a magnetic field corresponding to a first frequency; and enabling the energy harvesting mode when the magnetic element is placed within a magnetic field corresponding to a second frequency.

18. The method of claim 17, wherein enabling the EAS mode when the magnetic element is placed within a magnetic field corresponding to a first frequency comprises enabling an EAS circuit having a resonant frequency corresponding to the first frequency, and enabling the energy harvesting mode when the magnetic element is placed within a magnetic field corresponding to a second frequency comprises enabling an energy harvesting circuit having a resonant frequency corresponding to the second frequency, the energy harvesting circuit converting the second frequency voltage to a recharging signal for the rechargeable battery.

19. The method of claim 17, further comprising determining whether the magnetic element is placed within a magnetic field corresponding to the first frequency or to the second frequency.

20. The method of claim 17, further comprising producing an EAS alarm enable signal if the magnetic field corresponds to the first frequency and producing an energy harvesting signal if the magnetic field corresponds to the second frequency, the energy harvesting signal for recharging the rechargeable battery located within the EAS security tag.

* * * * *